US010836170B2

(12) United States Patent
Takeuchi

(10) Patent No.: US 10,836,170 B2
(45) Date of Patent: Nov. 17, 2020

(54) HEAD PROTECTOR, LIQUID DISCHARGE HEAD, AND LIQUID DISCHARGE APPARATUS

(71) Applicant: Noriyasu Takeuchi, Kanagawa (JP)

(72) Inventor: Noriyasu Takeuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/522,123

(22) Filed: Jul. 25, 2019

(65) Prior Publication Data

US 2020/0031125 A1 Jan. 30, 2020

(30) Foreign Application Priority Data

Jul. 30, 2018 (JP) ..... 2018-142364

(51) Int. Cl.
*B41J 2/165* (2006.01)
*B41J 2/175* (2006.01)
*B41J 29/12* (2006.01)

(52) U.S. Cl.
CPC ..... *B41J 2/165* (2013.01); *B41J 2/16505* (2013.01); *B41J 2/17536* (2013.01); *B41J 29/12* (2013.01); *B41J 2002/16502* (2013.01)

(58) Field of Classification Search
CPC .... B41J 2/165; B41J 2/16505; B41J 2/17536; B41J 29/12; B41J 2002/16502
See application file for complete search history.

(56) References Cited

U.S. PATENT DOCUMENTS 5,872,578 A * 2/1999 Takata ..... B41J 2/16508 347/29
6,206,499 B1 * 3/2001 Iijima ..... B41J 2/14024 347/20
2006/0279603 A1 12/2006 Kusunoki et al.
2014/0043393 A1 2/2014 Takeuchi
2015/0077469 A1 3/2015 Kohda et al.
2016/0297195 A1 10/2016 Takeuchi
2018/0194135 A1 7/2018 Iwama et al.
2018/0257374 A1 9/2018 Yoshida et al.
2018/0272709 A1 9/2018 Iwata et al.
2018/0272730 A1 9/2018 Odaka et al.
2019/0217607 A1 7/2019 Akiyama et al.

FOREIGN PATENT DOCUMENTS

JP 2000-190513 7/2000
JP 2007-326351 12/2007
JP 2014-172176 9/2014

* cited by examiner

*Primary Examiner* — Geoffrey S Mruk
(74) *Attorney, Agent, or Firm* — Oblon, McClelland, Maier & Neustadt, L.L.P.

(57) ABSTRACT

A head protector to be mounted to a liquid discharge head including a nozzle surface on which nozzles to discharge a liquid is formed, the head protector includes a cover surface to cover a part of the nozzle surface of the liquid discharge head, a fitting surface to be fitted to an attachment portion on a first side surface of the liquid discharge head, the first side surface intersecting the nozzle surface, and a biasing surface including a biasing part to bias the head protector against a second side surface of the liquid discharge head in a direction parallel to the nozzle surface, the second side surface intersecting the first side surface and the nozzle surface.

9 Claims, 15 Drawing Sheets

HEAD PROTECTOR, LIQUID DISCHARGE HEAD, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2018-142364, filed on Jul. 30, 2018 in the Japan Patent Office, the entire disclosure of which is hereby incorporated by reference herein.

BACKGROUND

Technical Field

The present disclosure relates to a head protector, a liquid discharge head, and a liquid discharge apparatus.

RELATED ART

A recording apparatus of an ink discharge type (inkjet recording apparatus or liquid discharge apparatus) includes a liquid discharge head (droplet discharge head) and is used as an image forming apparatus such as a printer, a facsimile, a copier, a plotter, and a multifunction peripheral, for example. Hereinafter, the "liquid discharge head" is simply referred to as the "head". The head includes nozzle surface on which a plurality of nozzles are formed. The head discharges a liquid from the plurality of nozzles onto a recording medium to form an image on the recording medium.

When an image is continuously formed by the liquid discharge apparatus that includes the head, the nozzles from which the liquid is discharged may be clogged with the hardened ink. Further, liquid droplets or foreign matter may adhere to the nozzle surface, and may be deposited and solidified on the nozzle surface. The liquid droplets or foreign matter adhered, deposited, or solidified on the nozzle surface may cause non-discharge of liquid from the nozzles, bending of discharge direction of the liquid, and the like. Thus, it is necessary to periodically remove the liquid droplets and the foreign matter adhered to the nozzle surface with a wiper or the like to prevent the occurrence of the discharge failure of the liquid droplets.

The head includes a head protector (hereinafter, also referred to as a "nozzle cover") that covers a peripheral edge of a nozzle surface to prevent a wiper that cleans the nozzle surface from being damaged by the edge of the nozzle surface.

The nozzle cover may cover all sides of periphery of the nozzle surface that includes four edges of the nozzle surface. However, if entire periphery of the nozzle surface is covered with the nozzle cover, each ends of the wiper contacts the nozzle cover, and a central portion of the wiper is separated from the nozzle surface. Thus, the wiper cannot wipe the nozzle surface.

Therefore, the wiper is pressed against the nozzle surface and is elastically deformed to contact the nozzle surface. Then, the wiper may not sufficiently wipe the residual ink (liquid droplets) adhered on a region of the nozzle surface closed to the nozzle cover.

SUMMARY

In an aspect of this disclosure, a head protector to be mounted to a liquid discharge head including a nozzle surface on which nozzles to discharge a liquid is formed is disclosed. The head protector includes a cover surface to cover a part of the nozzle surface of the liquid discharge head, a fitting surface to be fitted to an attachment portion on a first side surface of the liquid discharge head, the first side surface intersecting the nozzle surface, and a biasing surface including a biasing part to bias the head protector against a second side surface of the liquid discharge head in a direction parallel to the nozzle surface, the second side surface intersecting the first side surface and the nozzle surface.

BRIEF DESCRIPTION OF THE DRAWINGS

The aforementioned and other aspects, features, and advantages of the present disclosure will be better understood by reference to the following detailed description when considered in connection with the accompanying drawings, wherein:

FIGS. 2A to 2C illustrate an example of the head body constituting the liquid discharge head, wherein FIG. 2A is a side view of the head body, FIG. 2B is a front view of the head body, and FIG. 2C is a cross-sectional view of an internal configuration of the head body;

FIGS. 8A to 8C illustrate the frame member to which the head protector is fitted, wherein FIG. 8A is a plan view of a nozzle surface and the head protector, FIG. 8B is a side view in a longitudinal side of the frame member, and FIG. 8C is a side view in a transverse side of the frame member;

FIGS. 12A to 12C illustrate a head protector according to a second embodiment, wherein FIG. 12A is a perspective view of a back side of the head protector, FIG. 12B is a side view of the head protector, and FIG. 12C is a perspective view of a front side of the head protector opposite to FIG. 12A;

FIGS. 13A to 13C illustrate a head protector according to a third embodiment, wherein FIG. 13A is a perspective view of a back side of the head protector, FIG. 13B is a plan view of the head protector, and FIG. 13C is a perspective view of a front side of the head protector opposite to FIG. 13A;

FIGS. 18A and 18B illustrate an example of a liquid discharge apparatus, wherein FIG. 18A is schematic perspective views of the liquid discharge apparatus, and FIG. 18B is a side view of the liquid discharge apparatus.

Figure 1:
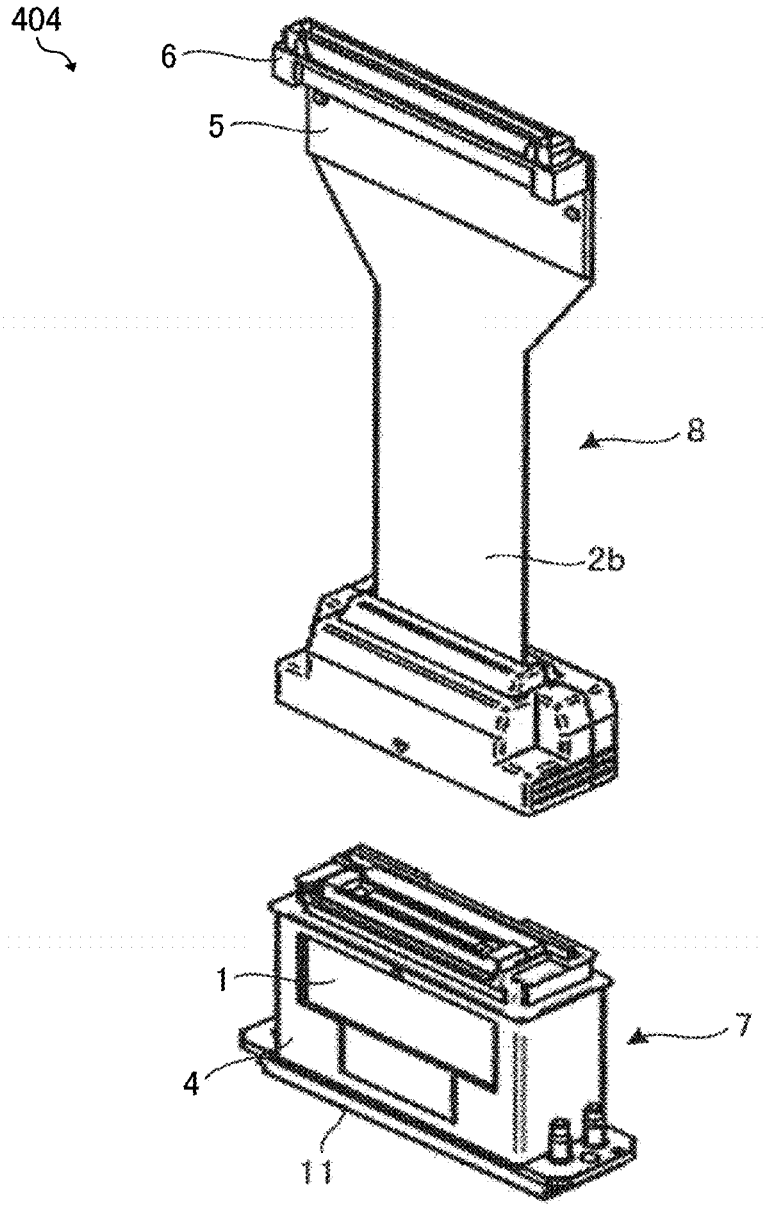
FIG. 1 is a schematic perspective view of an example of a liquid discharge head in a state in which a head body and a cable portion is separated.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in an analogous manner, and achieve similar results.

Although the embodiments are described with technical limitations with reference to the attached drawings, such description is not intended to limit the scope of the disclosure and all the components or elements described in the embodiments of this disclosure are not necessarily indispensable. As used herein, the singular forms "a", "an", and "the" are intended to include the plural forms as well, unless the context clearly indicates otherwise.

Hereinafter, a liquid discharge head protector, a liquid discharge head, and a liquid discharge apparatus according to the present disclosure is described with reference to the drawings. Note that the present disclosure is not limited to the following embodiments and may be other embodiments. The following embodiments may be modified by, e.g., addition, modification, or omission within the scope that would be obvious to one skilled in the art. Any aspects having advantages as described for the following embodiments according to the present disclosure are included within the scope of the present disclosure.

The liquid discharge head protector according to the present disclosure is a protector mounted on a liquid discharge head that has a nozzle surface on which a plurality of nozzles are formed. Hereinafter, the "liquid discharge head protector" is simply referred to as the "head protector".

[Liquid Discharge Head]

In the present application, the "liquid discharge head" is a functional component that discharges a liquid from a nozzle. The nozzle is also referred to as a nozzle-hole. Hereinafter, the "liquid discharge head" is simply referred to as the "head".

Liquid to be discharged from the nozzles of the head is not limited to a particular liquid as long as the liquid has a viscosity or surface tension to be discharged from the liquid discharge head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The terms "image formation", "recording", "printing", "image printing", and "fabricating" used herein may be used synonymously with each other.

The head to which the head protector according to the present disclosure is fitted is described according to FIGS. 1 to 4.

FIG. 1 is a schematic perspective view of an example of the head in a state in which a head body and a head cable are separated.

Figure 2C:
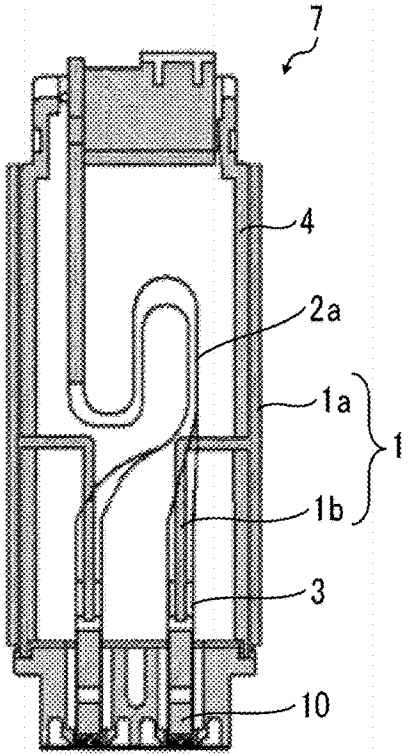
Figure 2B:
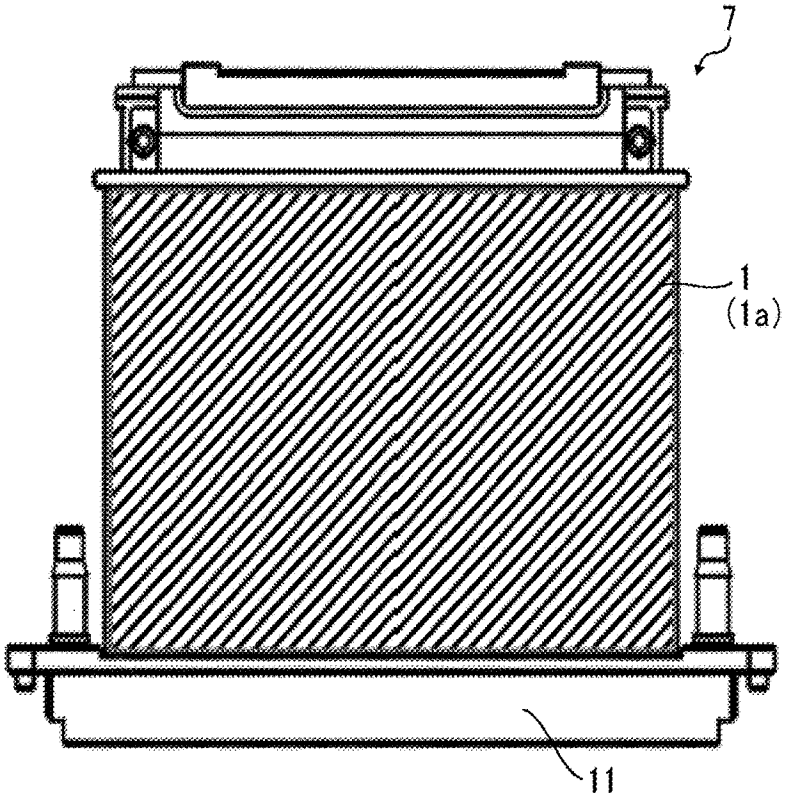
Figure 2A:
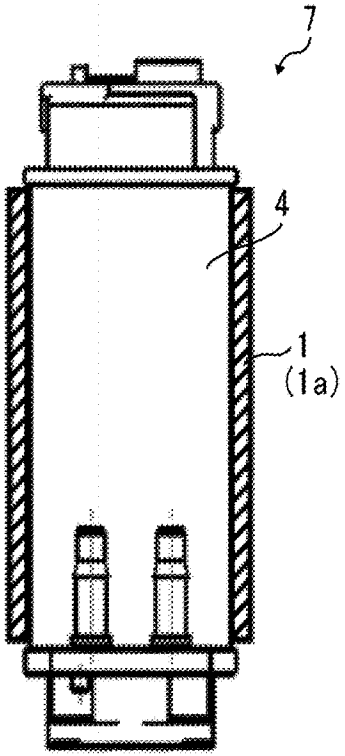

FIGS. 2A to 2C illustrate an example of a head body constituting the head. FIG. 2A is a side view of the head body.

FIG. 2B is a front view of the head body.

FIG. 2C is a cross-sectional view of the head body illustrating an internal structure of the head body.

The head 404 according to the present embodiment has a head body 7 and a cable portion 8 as illustrated in FIG. 1.

The head body 7 includes a chamber part 11, a drive controller 3, a heat radiation member 1, and a cover 4. The chamber part 11 drives a pressure generation element 10 to apply pressure to a liquid in a pressure chamber and discharges the liquid from the nozzle. The drive controller 3 controls to drive the pressure generating element 10. The heat radiation member 1 is in contact with the drive controller 3.

Further, the head 404 includes a wiring to transmit a signal to the drive controller 3. The wiring is separable from the head body 7 including the heat radiation member 1. Specifically, as illustrated in FIG. 1, the head 404 includes a cable 8 as the wiring that is separable from the head body 7. The cable 8 has a higher-order device transmission wiring 2*b*. An example of the higher-order device is a host device or a server, for example.

The cable 8 as the wiring includes the higher-order device transmission wiring 2*b* and a relay wiring 2*a*. The higher-order device transmission wiring 2*b* is bendable and is connected to a connector board 5. The higher-order device transmission wiring 2*b* transmits electrical signal from the higher-order device via a connector 6. The relay wiring 2*a* electrically connects the higher-order device transmission wiring 2*b* and the pressure generating element 10.

The drive controller 3 is mounted on the relay wiring 2*a* and controls to drive the pressure generation element 10 based on the electric signal from the higher-order device.

The cover 4 accommodates and protects the relay wiring 2*a* and the drive controller 3.

The heat radiation member 1 (heat sink) radiates heat generated from the drive controller 3 outside the head body 7.

In an example of a configuration illustrated in FIG. 2, the heat radiation member 1 is disposed outside the cover 4. The heat radiation member 1 includes a first heat radiation member 1*a* and a second heat radiation member 1*b*. The first heat radiation member 1*a* includes a surface in contact with the outside air. The second heat radiation member 1*b* is disposed inside the cover 4 and includes an end contacting the drive controller 3. The first heat radiation member 1*a* and the second heat radiation member 1*b* contact with each other. The heat radiation members 1 are respectively provided on the opposite surfaces of the cover 4 as illustrated in FIGS. 2A and 2C.

A configuration example of the chamber part 11 is described with reference to FIGS. 3 and 4.

Figure 3:
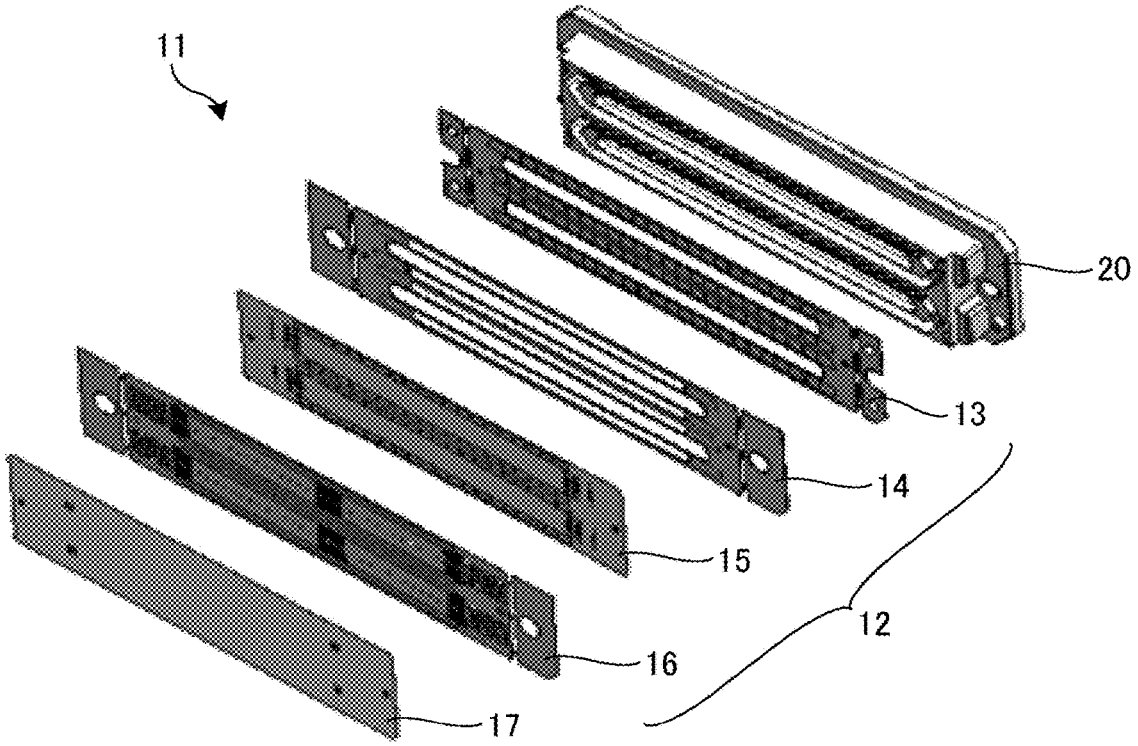
FIG. 3 is an exploded schematic perspective view of a chamber part in which a channel member and a housing that constitute the chamber part are separated.

FIG. 3 is a schematic exploded perspective view of a channel member 12 and a frame member 20 constituting the chamber part 11.

The chamber part 11 includes the frame member 20, a filter plate 13, a manifold 14, a diaphragm 15, a restrictor plate 16, and a nozzle plate 17 (orifice plate). Lamination from the filter plate 13 to the nozzle plate 17 forms the channel member 12.

The diaphragm 15 is bonded to the pressure generating element 10.

When a voltage is applied to the pressure generation element 10 bonded to a stainless steel (SUS) base, the pressure generation element 10 distorts to compress the individual chamber formed of the restrictor plate 16 through the diaphragm 15, and the liquid (ink) is thus discharged from the nozzles in the nozzle plate 17. Heat is generated in the drive controller 3 during the liquid discharge. The heat radiation member 1 bonded to the drive controller 3 release the heat generated at the drive controller 3 outside the head body 7.

In the following description, the frame member 20 holding the channel member 12 is described as a member holding the nozzle plate 17. The channel member 12 is, specifically, a member from the filter plate 13 to the restrictor plate 16. The member holding the nozzle plate 17 is described as a chamber forming member.

The chamber part 11 includes at least the nozzle plate 17, the channel member 12, and the frame member 20.

Figure 4:
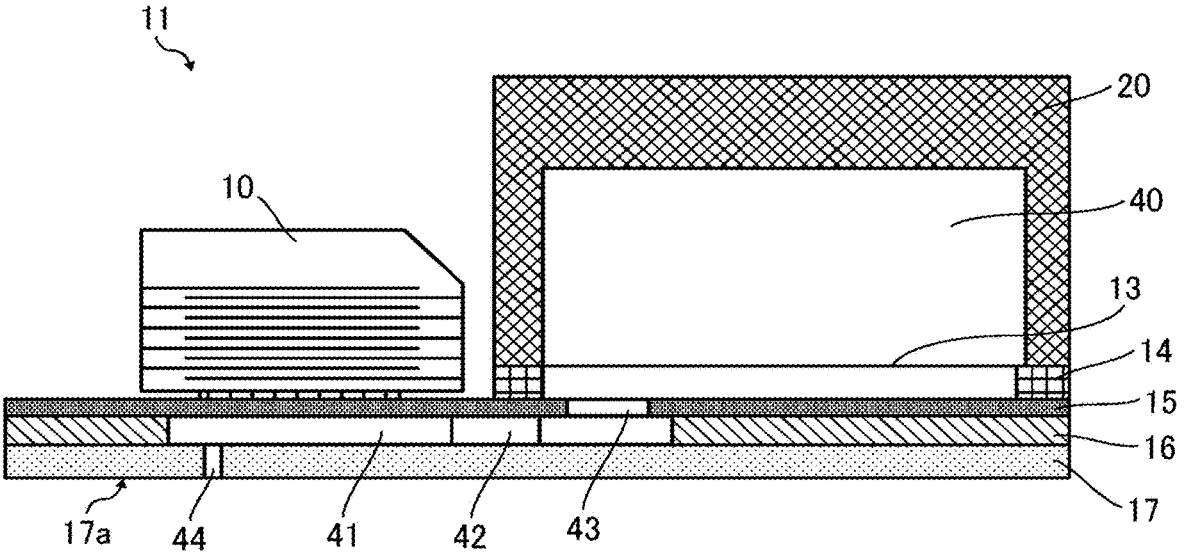
FIG. 4 is a schematic cross-sectional side view in a direction perpendicular to a nozzle array direction of the liquid discharge head.

FIG. 4 is a schematic cross-sectional view of the chamber part 11 in a direction perpendicular to a nozzle array direction of the head.

The head 404 according to the present embodiment includes a nozzle plate 17, a restrictor plate 16, a frame member 20, ad diaphragm 15, a pressure generating element 10, and a drive integrated circuit (IC). The nozzle plate 17 includes a plurality of nozzles 44 arranged in the nozzle array direction to discharge liquid droplets. The restrictor plate 16 is bonded to the nozzle plate 17 to form a plurality of individual chambers 41 communicating with the nozzles 44, respectively.

The frame member 20 as a common chamber forms a common chamber 40 to supply liquid to the plurality of individual chambers 41. The diaphragm 15 disposed on a surface opposite to a surface of the restrictor plate 16 on which the nozzle plate 17 is bonded. The pressure generation element 10 is formed on the diaphragm 15. The drive IC applies a voltage to the pressure generation element 10.

The liquid in the common chamber 40 is supplied to the individual chamber 41 from an opening 43 of the diaphragm 15 through a fluid restrictor 42. The liquid is supplied to the common chamber 40 from a liquid storage through the supply channel.

The common chamber 40 is always kept being filled with the liquid.

The diaphragm 15 forms a part of a wall of the individual chamber 41. Expansion and contraction of the pressure generation element 10 deforms the diaphragm 15 to generate volume change in the individual chamber 41 a pressure change of the liquid in the individual chamber 41. Thus, the head 404 discharges the liquid in the individual chamber 41 from the nozzle 44.

[Head Protector]

The head protector 30 prevents a wiper 50 to be damaged by an end of the nozzle surface 17*a* when the nozzle surface 17*a* is wiped by the wiper in the above-described head. Further, the head protector 30 prevents the nozzle plate 17 to be peeled off by the wiper 50 contacting the nozzle plate 17.

Figure 5:
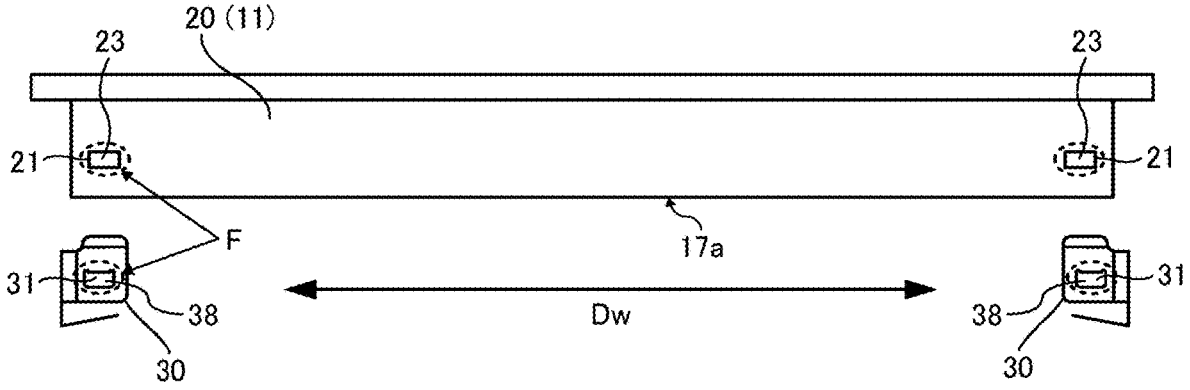
FIG. 5 is a side view of an example of a head protector and a frame member in the nozzle array direction.
Figure 6:
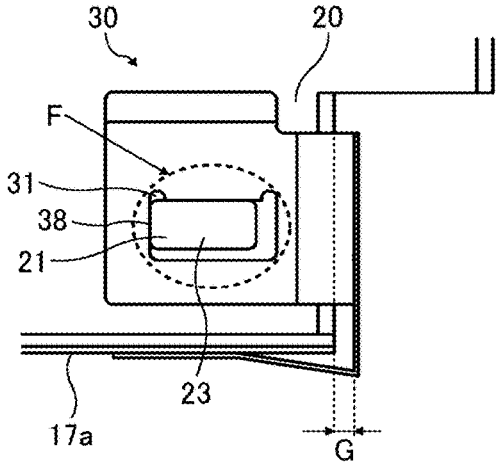
FIG. 6 is an exploded partial side view of the head protector and the frame member including a fitting portion.

FIGS. 5 to 7 illustrate an example of the head protector 30.

FIG. 5 is a side view of the frame member 20 and the head protector 30 in a state before the head protector 30 is attached to the frame member 20 configuring the chamber part 11.

The head protectors 30 are mounted to the frame member 20 so that the head protectors 30 cover each ends of the nozzle surface 17*a* and a part of the frame member in a longitudinal direction of the frame member 20. Specifically, each of the head protectors 30 is attached to the frame member 20 such that the head protector 30 covers one end of the nozzle surface 17*a* in a wiping direction Dw of the wiper 50.

As illustrated in FIG. 5, the frame member 20 includes attachment portions 21 on both side surfaces of the frame member 20 in the longitudinal direction of the frame member 20. The side surface of the frame member 20, on which the attachment portion 21 is formed, is a surface substantially perpendicular to the nozzle surface 17*a* and is a surface parallel to a lamination direction of the channel member 12.

Note that a part of the side surface of the frame member 20 at the transverse direction side is also covered with the head protector 30.

The head protectors 30 have a configuration to individually cover each ends of the nozzle surface 17*a* and the frame member 20 in the wiping direction Dw with separate members.

Each of the head protectors 30 includes a fitting structure 31 that can be respectively fitted to the attachment portions 21 formed on the frame member 20. The attachment portion 21 and the fitting structure 31 constitute a fitting portion F indicated by a broken circle in the FIG. 6.

The attachment portion 21 formed on the frame member 20 preferably includes a projection or a claw-like convex portion. The fitting structure 31 preferably includes a recess or an opening that can be fitted to the projection or the claw-like convex portion of the attachment portion 21.

If the recess is formed on the frame member 20 side, the recess has to be formed so that the recess does not interfere the channels, etc., inside the chamber part 11 that may increase the size of the frame member 20.

Conversely, if the head protector 30 includes a projection, the head protector 30 may not be reliably fitted to the frame member 20 by the projection of the head protector 30 because the head protector 30 is preferably formed of a thin plate-like member with an elastically deformable material.

Further, a fitting hole formed in the head protector 30 has to have a shape not to be deformed by a force concentratedly received by the wiping operation of the wiper. The deformation of the fitting hole may increase the displacement of the head protector 30.

It is described below a configuration in which the attachment portion 21 includes a fitting projection 23 and the fitting structure 31 includes a fitting hole 38. The configuration of the fitting portion F is not limited to the above-described configurations.

FIG. 6 is an exploded side view of a portion of the frame member 20 and the head protector 30 including the fitting portion F.

In FIG. 6, the fitting hole 38 of the fitting structure 31 is fitted to the fitting projection 23 of the attachment portion 21 so that the head protector 30 is attached to the frame member 20. To simply attach the head protector 30 to the frame member 20, the fitting structure 31 has a structure to be fitted to the attachment portion 21 with a clearance.

When the head protector 30 is fixed at a position to increase the clearance (a left end of the fitting projection 23 contacts a left end of the fitting hole 38 in FIG. 6), a gap as indicated by "G" in FIG. 6 is formed between the head protector 30 and the frame member 20. Thus, the head protector 30 is movable within a range of the clearance. However, a contact portion between the nozzle surface 17*a* and the head protector 30 may be damaged due to movement of the head protector 30 within the range of the clearance.

As described above, the attachment portion 21 includes a projection, and the fitting surface 30*b* includes a hole to which the projection of the attachment portion 21 is fittable. The hole has a size larger than the projection in the direction parallel to the nozzle surface 17*a* to form a gap "G".

FIG. 7 is an exploded side view of a portion of the frame member 20 and the head protector 30. Specifically, FIG. 7 illustrates a movement of the head protector 30 caused by the clearance of the fitting portion F.

Figure 7B:
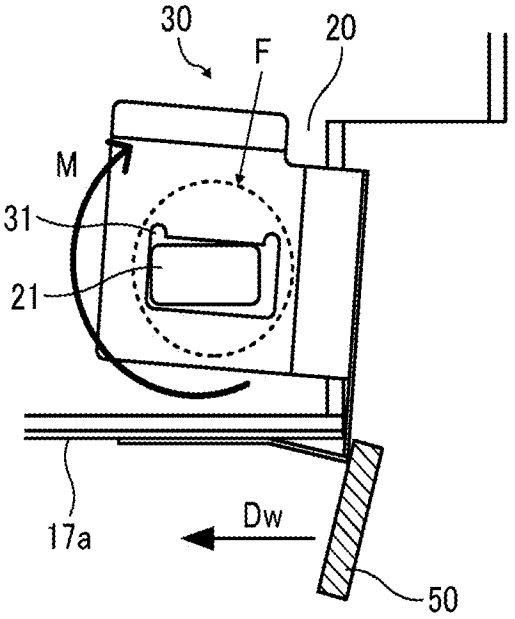
FIGS. 7A and 7B are a side view of the head protector and the frame member that illustrate a movement of the head protector due to a clearance of the fitting portion.
Figure 7A:
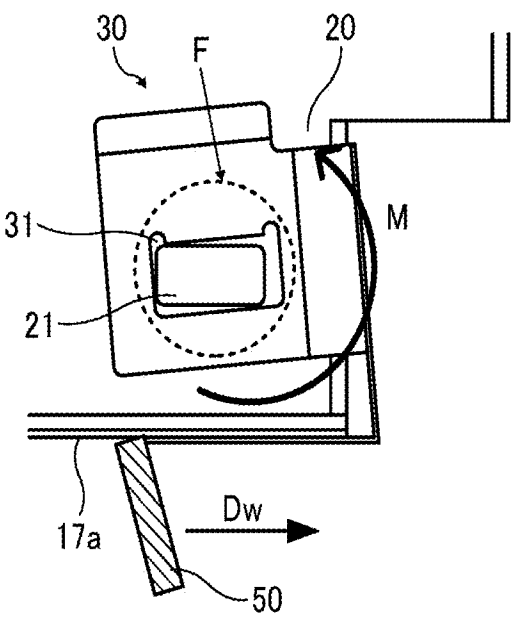

As illustrated in FIG. 7A and FIG. 7B, the head protector 30 receives a force in a thrust direction when the wiper 50 further moves in the wiping direction Dw from a state in which the wiper 50 contacts the end of the head protector 30. At the time of receiving the force in the thrust direction, the fitting portion "F" receives a moment force indicated by an arrow "M" that causes a displacement of the head protector 30.

To prevent the displacement of the head protector 30 as illustrated in FIGS. 7A and 7B, there is a method of fixing a side surface of the frame member 20 with a screw or the like. However, if the screw is used to fix the head protector 30 to the side surface of the frame member 20, a space is needed to attach the screw to the head protector 30 and the frame member 20 in order to avoid interference between the screw and a structure inside the chamber part 11. Thus, fixing with screw leads to an increase in the size of the head 404. The head protector 30 may be bonded to the side surface of the frame member 20 with an adhesive or the like. However, bonding has a problem in durability.

Peeling off of the head protector 30 may damage the nozzle surface 17*a* or may affect image quality of the image forming apparatus.

Conversely, the head protector 30 according to the present disclosure includes a biasing part 32 to reduce the displacement of the head protector 30 with a bias force of the biasing part 32. That is, the head protector 30 according to the present disclosure can prevent the movement of the head protector 30 accompanied with the operation of the wiper 50 by the bias force of the biasing part 32. Thus, the head protector 30 can prevent abrasion of a water-repellent film on the nozzle surface 17*a* due to rubbing of the nozzle surface 17*a* by the head protector 30.

The head protector 30 according to the present disclosure includes a cover surface 30*c* that covers a part of the nozzle surface 17*a*, a fitting surface 30*b* that fits on the attachment portion 21 on the head 404, and a biasing surface 30*a* including a biasing part 32 that intersects the fitting surface 30*b*. A bias direction of the head protector 30 by the biasing part 32 is substantially parallel to the wiping direction Dw of the wiper 50 to wipe the nozzle surface 17*a*. Further, the fitting surface 30*b* is substantially parallel to the wiping direction Dw.

In other words, a biasing surface 30*a* of the head protector 30 includes a biasing part 32 to bias the head protector 30 against a second side surface (a surface of the frame member 20 facing the biasing surface 30*a*) of the head 404 in a direction parallel to the nozzle surface 17*a*. The second side surface intersects (perpendicular to) the first side surface (a surface of the frame member 20 facing the fitting surface 30*b*) and the nozzle surface 17*a*.

The biasing part 32 is preferably provided at a position that can effectively prevent the rotational movement of the fitting portion "F" which receives the moment force M as the wiper 50 moves.

Specifically, a center of the biasing part 32 is preferably disposed above a center of the attachment portion 21 in a vertical direction perpendicular to the wiping direction Dw of the wiper 50 in which the nozzle surface 17*a* is positioned downward in the vertical direction. The attachment portion 21 fits to the fitting surface of the head protector 30.

Thus, a center of the biasing part 32 is disposed above a center of the attachment portion 21 to which the fitting surface 30*b* is fitted in a vertical direction perpendicular to the nozzle surface 17*a*, and the nozzle surface 17*a* is disposed below the center of the attachment portion 21 in the vertical direction.

First Embodiment

FIGS. 8A to 8C through FIG. 11 illustrate a first embodiment of the head protector 30 according to the present disclosure.

Figure 8A:
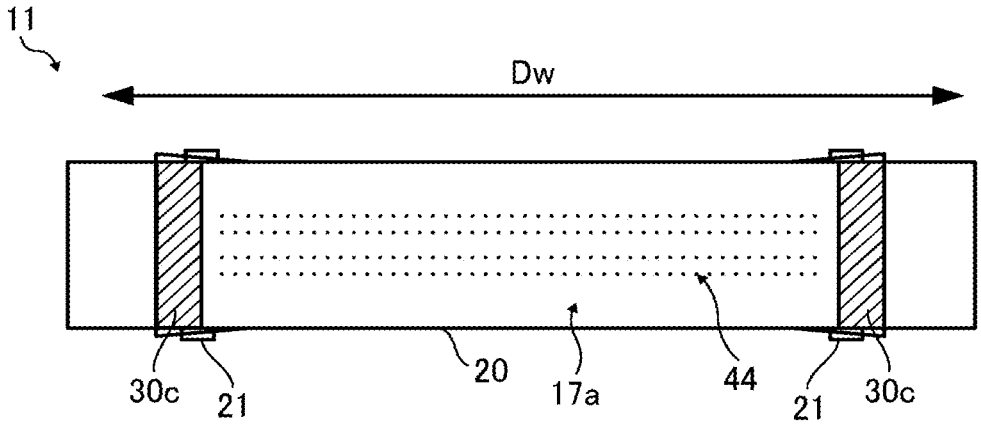
Figure 8B:
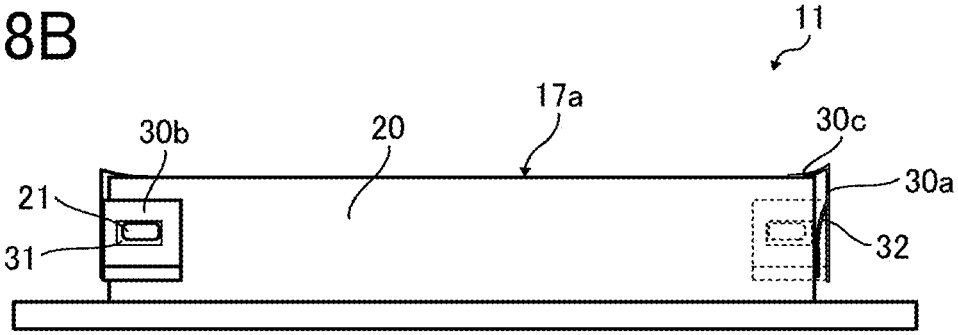
Figure 8C:
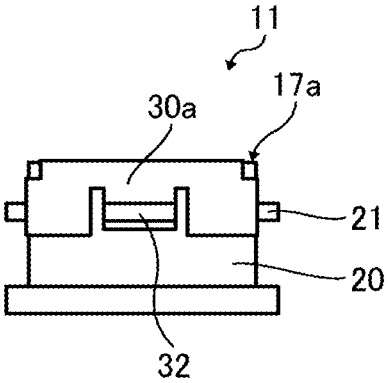

FIGS. 8A to 8C illustrate the head protector 30 fitted to the frame member 20 constituting the chamber part 11.

FIG. 8A is a plan view of the nozzle surface 17*a*.

FIG. 8B is a side view of the longitudinal side of the frame member 20.

FIG. 8C is a side view of the transverse side of the frame member 20.

Figure 9:
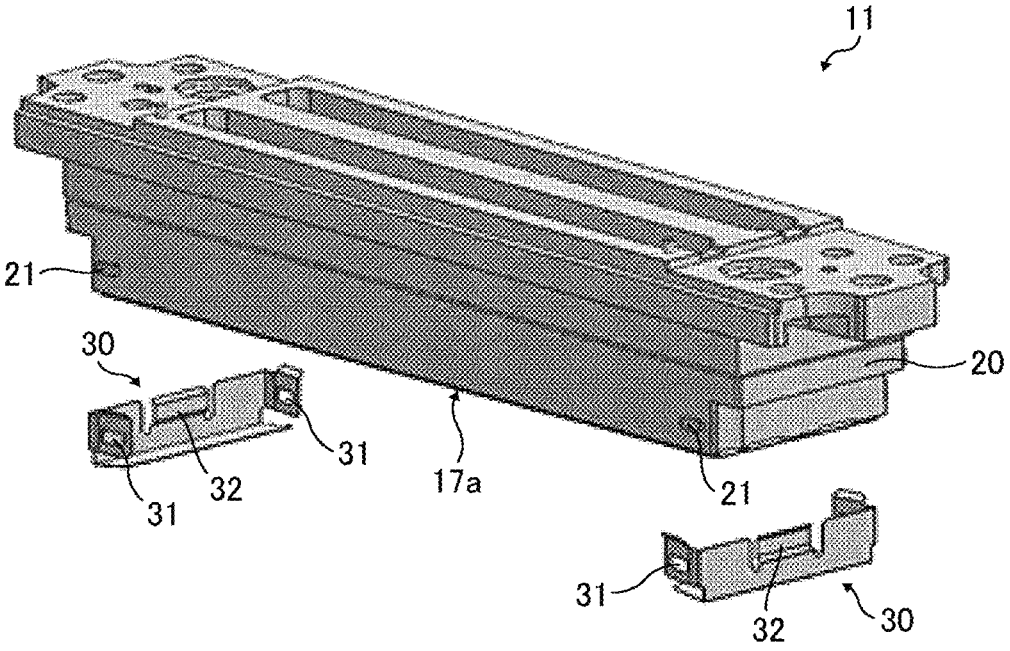
FIG. 9 is a schematic perspective view of the head protector and the frame member in a state before the head protector is fitted to the frame member.

FIG. 9 is a schematic perspective view of the frame member 20 in a state before the head protector 30 is fitted to the frame member 20.

Figure 10:
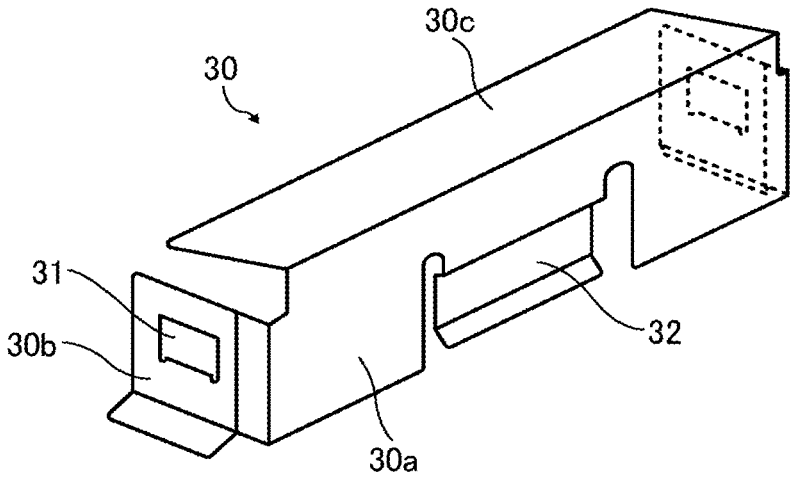
FIG. 10 is a schematic perspective view of the head protector according to a first embodiment of the present disclosure.

FIG. 10 is a schematic perspective view of the head protector 30.

Figure 11:
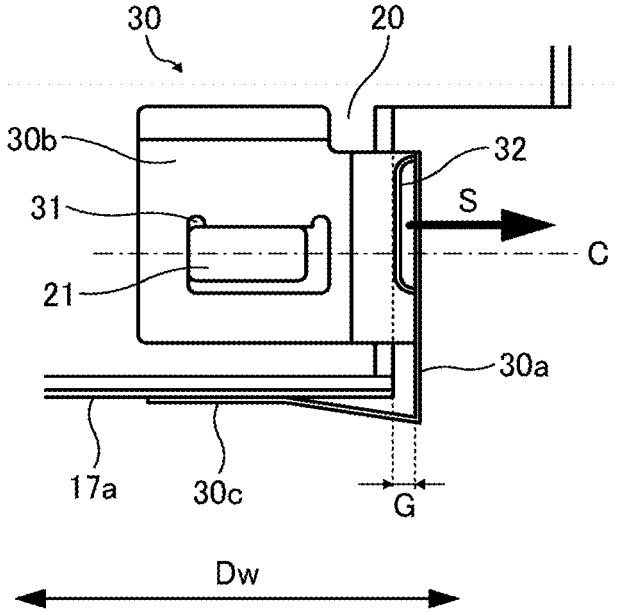
FIG. 11 is a side view of the head protector and the frame member including the fitting portion according to the first embodiment.

FIG. 11 is a side view of the head protector 30 and the frame member 20 including a fitting portion F.

The head protector 30 according to the present disclosure is attached and fitted to the head 404. The head 404 includes a nozzle plate 17 having a nozzle surface 17*a* in which a plurality of nozzles 44 are formed, a channel member 12 formed of a plurality of laminated plate members, and the chamber part 11 formed of the frame member 20.

The head protector 30 includes a cover surface 30*c*, a pair of fitting surfaces 30*b*, and a biasing surface 30*a*. The cover surface 30*c* covers at least one end of the nozzle surface 17*a* in the wiping direction Dw of the wiper 50. The pair of fitting surfaces 30*b* is fittable to the attachment portions 21 provided on both sides in the longitudinal direction of the frame member 20. The biasing surface 30*a* contacts a surface of the frame member 20 in the transverse side of the frame member 20. The biasing surface 30*a* includes a biasing part 32 to press the frame member 20 when the head protector 30 is fitted to the frame member 20.

The bias direction of the biasing part 32 is substantially parallel to the wiping direction Dw, and the biasing part 32 biases the head protector 30 in a direction away from the frame member 20. The fitting surface 30*b* is substantially parallel to the wiping direction Dw.

In other words, a biasing surface 30*a* of the head protector 30 includes a biasing part 32 to bias the head protector 30 against a second side surface (a surface of the frame member 20 facing the biasing surface 30*a*) of the head 404 in a direction parallel to the nozzle surface 17*a*. The second side surface intersects (perpendicular to) the first side surface (a surface of the frame member 20 facing the fitting surface 30*b*) and the nozzle surface 17*a*.

Further, the fitting structure 31 of the fitting surface 30*b* is a structure that fits to the attachment portion 21 of the frame member 20 with a clearance. The displacement generated in a range of the clearance of the fitting structure 31 is preferably reduced by the bias force of the biasing part 32.

Thus, a pair of fitting surfaces 30*b* is opposed to each other, and the pair of fitting surfaces 30*b* is perpendicular to the biasing surface 30*a*.

In the present embodiment, the attachment portion 21 formed on the frame member 20 is a fitting projection, and the fitting structure 31 of the fitting surface 30*b* is a fitting hole that is fittable to the fitting projection with a clearance with the fitting projection.

As illustrated in FIG. 10, the head protector 30 includes the cover surface 30*c* and the biasing surface 30*a*. The biasing surface 30*a* is bent at an angle of less than 90 degrees to the cover surface 30*c*. Further, the biasing surface 30*a* includes the fitting surface 30*b* on both side surfaces in the longitudinal side of the frame member 20.

The plate thickness of the head protector 30 is preferably small, for example, preferably 0.1 mm or less. With an increase in the plate thickness of the head protector 30, a resistance occurred between the wiper 50 and the head protector 30 increases when the wiper 50 passes an edge of the cover surface 30*c* of the head protector 30. Thus, the wiper 50 may be damaged by the edge of the cover surface 30*c* of the head protector 30.

Further, the head protector 30 is preferably applied with a water repelling treatment. The water-repellent treatment may be applied on all or part of the surface of the head protector 30. The water-repellent treatment is preferably applied at least to the cover surface 30*c* of the head protector 30 because the cover surface 30*c* contacts the nozzle surface 17*a* and the liquid (ink).

A well-known water repelling treatment may be applied to the head protector 30. For example, the head protector 30 may be coated with a water-repellent material to form a water-repellent film etc. on the head protector 30.

As illustrated in FIG. 11, the biasing part 32 provided on the biasing surface 30*a* biases the frame member 20 in a direction away from the frame member 20 (the direction indicated by the arrow "S" in FIG. 11) in a state in which the head protector 30 is fitted to the frame member 20.

In FIG. 11, a center of the attachment portion 21 to be fitted to the fitting surface 30*b* is indicated by "C" in a vertical direction perpendicular to the wiping direction Dw. In FIG. 11, the nozzle surface 17*a* is illustrated at lower side in the vertical direction. A center of the biasing part 32 is preferably disposed above the center C of the attachment portion 21 in a vertical direction in FIG. 11.

When the head protector 30 is fitted to the frame member 20, there is a gap G existed between the head protector 30 and the frame member 20 because of the clearance of the fitting portion F. However, the head protector 30 can be fixed to the frame member 20 at a position where the gap G is increased to the maximum value by the biasing part 32. Thus, the head protector 30 according to the present disclosure can reduce the displacement occurred by the clearance.

The head protector 30 is preferably formed of an elastic member.

As the elastic member for the head protector 30, a hard metal material such as a stainless steel (SUS) material may be used. The head protector 30 is preferably formed of a thin material that can obtain a sufficient bias force. For example, it is preferable to use a SUS304-CSP-H-TA material having a thickness of 0.1 mm or less.

The head protector 30 according to the present disclosure elastically deforms the biasing part 32 and presses the frame member 20. The biasing part 32 formed by an elastic member can quantify a state of close contact between the head protector 30 and the frame member 20 in mechanical design.

Further, controlling an amount of deformation of the head protector 30 at the time of attachment of the head protector 30 to the frame member 20 enable a state of close contact between the head protector 30 and the frame member 20 according to the clearance (gap G) as described-above. Thus, the present disclosure can reliably reduce the displacement of the head protector 30.

A shape of the biasing part 32 is not limited to the above-described embodiments as long as the biasing part 32 can be elastically deformed and has a convex shape projected toward the frame member 20.

An embodiment of the head protector 30 including the biasing part 32 having another shape is described below.

Second Embodiment

Figure 12A:
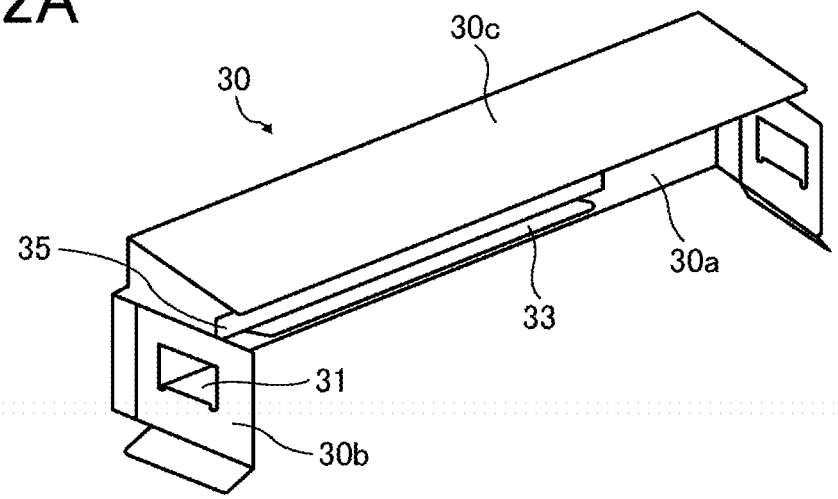
Figure 12B:
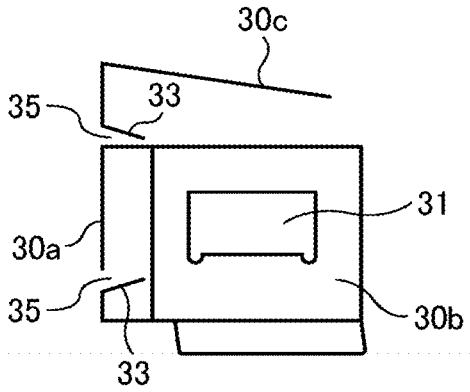
Figure 12C:
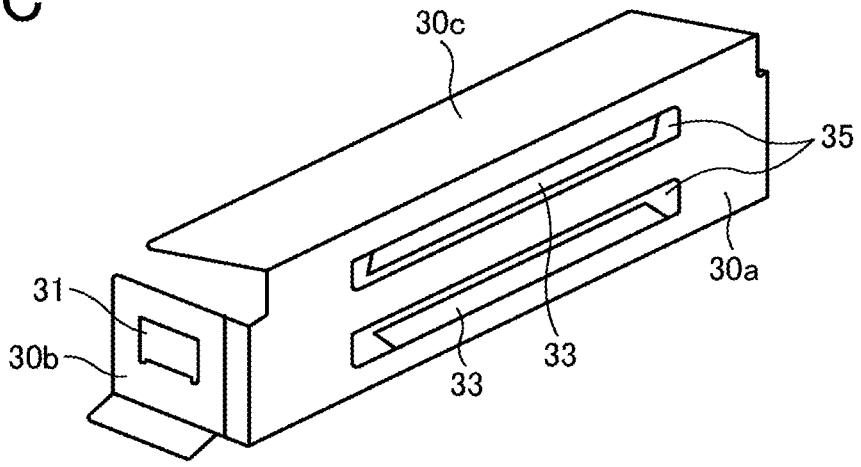

A second embodiment of the head protector 30 according to the present disclosure is described with referring to FIGS. 12A to 12C.

FIGS. 12A to 12C illustrate schematic views of the head protector 30 according to the second embodiment.

FIG. 12A is a perspective view of the head protector 30 of the second embodiment.

FIG. 12B is a side view of the head protector 30 seen from the fitting surface 30*b*.

FIG. 12C is a perspective view of the head protector 30 seen from a side opposite to a side of FIG. 12A.

The head protector 30 in FIGS. 12A to 12C includes a slit 35 extending along a longitudinal direction of the head protector 30. A portion of the biasing surface 30*a* is cut and bent to form the slit 35, and a bent portion becomes the biasing part 33. The head protector 30 in the present disclosure includes two slits 35 extending in the longitudinal direction of the head protector 30. However, a number of slit 35, a position of the slit 35, and a shape of the slit 35 are not limited to the embodiments as described above. For example, the number of the slit 35 may be one or more than two.

Third Embodiment

Figure 13A:
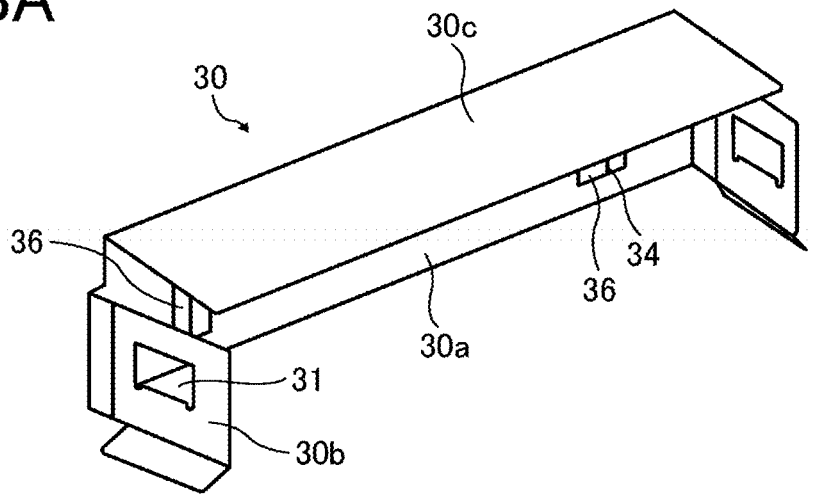
Figure 13B:
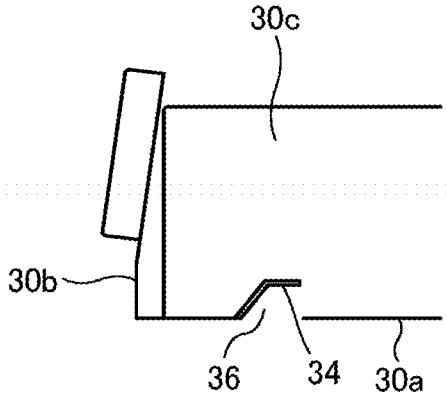
Figure 13C:
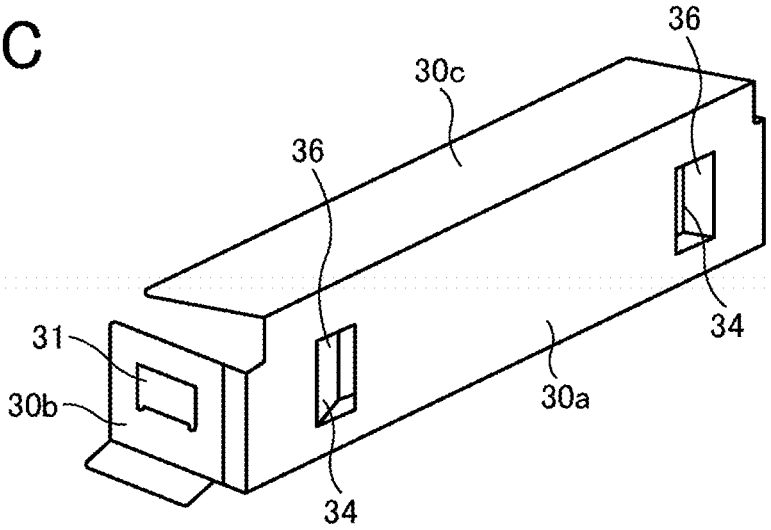

A third embodiment of the head protector 30 according to the present disclosure is described with referring to FIGS. 13A to 13C.

FIGS. 13A to 13C illustrate schematic views of the head protector 30 according to the third embodiment.

FIG. 13A is a perspective view of the head protector 30 of the third embodiment.

FIG. 13B is a partial plan view of the cover surface 30*c* viewed from the inside.

FIG. 13C is a perspective view of the head protector 30 seen from a side opposite to a side of FIG. 13A.

The head protector 30 in FIGS. 13A to 13C includes a slit 36 extending along a transverse direction of the head protector 30. A portion of the biasing surface 30*a* is cut and bent to form the slit 36, and a bent portion becomes the biasing part 34. The biasing surface 30*a* is cut and bended two times to form the biasing part 34. Thus, the biasing part 34 has a surface to contact a surface of the frame member 20.

The head protector 30 in the present disclosure includes two slits 36 extending in the transverse direction (height direction in FIG. 13C) of the head protector 30. However, a number of slit 36, a position of the slit 36, and a shape of the slit 36 are not limited to the embodiments as described above. For example, the number of the slit 36 may be one or more than two.

Fourth Embodiment

Figure 14:
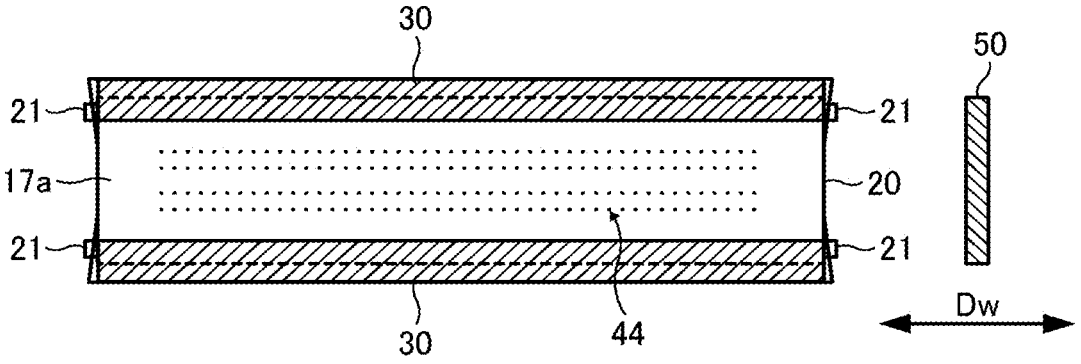
FIG. 14 illustrate a head protector according to a fourth embodiment.

A fourth embodiment of the head protector 30 according to the present disclosure is described with referring to FIG. 14.

FIG. 14 is a plan view of the head protector 30 and the nozzle surface 17*a* according to the fourth embodiment.

As illustrated in FIG. 14, the head protectors 30 is provided to each ends of the frame member 20 in the transverse direction (perpendicular to the wiping direction Dw). Thus, a longitudinal direction of the head protector 30 is along the wiping direction (Dw) and also along a longitudinal direction of the frame member 20.

Each of the head protectors 30 includes the biasing part 34 so that the head protector 30 according to the present disclosure can prevent the movement of the head protector 30 accompanied with the operation of the wiper 50 by the bias force of the biasing part 32. Thus, the head protector 30 can prevent abrasion of a water-repellent film on the nozzle surface 17*a* due to rubbing of the nozzle surface 17*a* by the head protector 30.

[Liquid Discharge Apparatus]

The liquid discharge apparatus 500 according to the present disclosure is an apparatus to drive the liquid discharge head to discharge a liquid. The liquid discharge apparatus 500 includes a liquid discharge head having a head protector according to the present disclosure or a liquid discharge device including the liquid discharge head.

The durability of the head 404 is improved by the head protector 30 according to the present disclosure, so the number of head replacements can be reduced.

The liquid discharge apparatus may be, for example, an apparatus capable of discharging liquid to a material to which liquid can adhere and an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrary images, such as arbitrary patterns, or fabricate three-dimensional images.

The above-described term "material on which liquid can be adhered" represents a material on which liquid is at least temporarily adhered, a material on which liquid is adhered and fixed, or a material into which liquid is adhered to permeate.

Examples of the "material on which liquid can be adhered" include recording media, such as paper sheet, recording paper, recording sheet of paper, film, and cloth, electronic part, such as electronic substrate and piezoelectric element, and media, such as powder layer, organ model, and testing cell. The "material on which liquid can be adhered" includes any material on which liquid is adhered, unless particularly limited.

Examples of the "material on which liquid can be adhered" include any materials on which liquid can be adhered even temporarily, such as paper, thread, fiber, fabric, leather, metal, plastic, glass, wood, and ceramic.

Further, the term "liquid" includes any liquid having a viscosity or a surface tension that can be discharged from the liquid discharge head. However, preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant. Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge a treatment liquid to a sheet to coat the treatment liquid on the surface of the sheet to reform the sheet surface and an injection granulation apparatus in which a composition liquid including raw materials dispersed in a solution is injected through nozzles to granulate fine particles of the raw materials.

The term "liquid discharge device" represents a unit in which the head and other functional parts or mechanisms are combined, in other words, an assembly of parts relating to the liquid discharge function. For example, the "liquid discharge device" includes a combination of the head with at least one of a head tank, a carriage, a supply unit, a recovery device, and a main scan moving unit.

Examples of the "single unit" include a combination in which the head and one or more functional parts and units are secured to each other through, e.g., fastening, bonding, or engaging, and a combination in which one of the head and the functional parts and units is movably held by another. The head may be detachably attached to the functional part(s) or unit(s) s each other.

Figure 15:
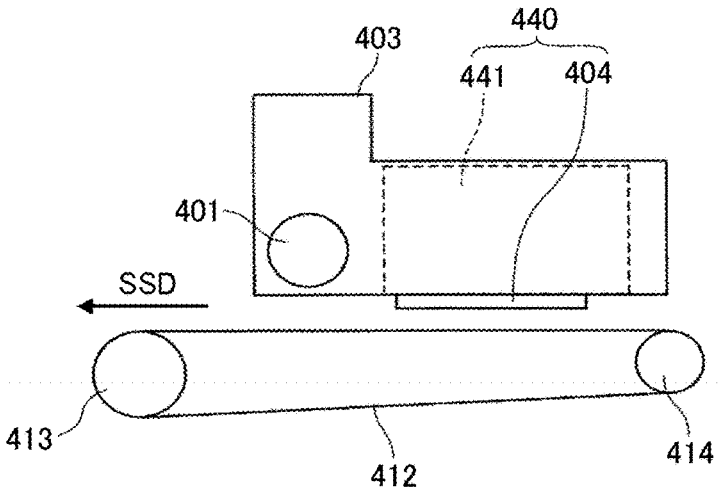
FIG. 15 is a side view of an example of a liquid discharge device.

FIG. 15 is a side view of an example of a liquid discharge device 440. For example, the head 404 and a head tank 441 form the liquid discharge device 440 as a single unit in FIG. 15.

Further, the liquid discharge device 440 includes the head 404 mounted on the carriage 403 in FIG. 15. The carriage 403 is held by a guide 401 constituting a main scan moving unit 493, and is reciprocally moves in a main scanning direction indicated by arrow "MSD" in FIG. 16.

As illustrated in FIG. 15, the liquid discharge device 440 includes a conveyance belt 412 to convey a recording medium (for example, a sheet) among members constituting a liquid discharge apparatus 500 as described below. The conveyance belt 412 is an endless belt and is stretched between the conveyance roller 413 and the tension roller 414.

Alternatively, the head 404 and the head tank 441 coupled (connected) with a tube or the like may form the liquid discharge device 440 as a single unit. Here, a unit including a filter may further be added to a part between the head tank 441 and the head 404.

In another example, the liquid discharge device 440 may include the head 404 and the carriage 403 to form a single unit.

Figure 16:
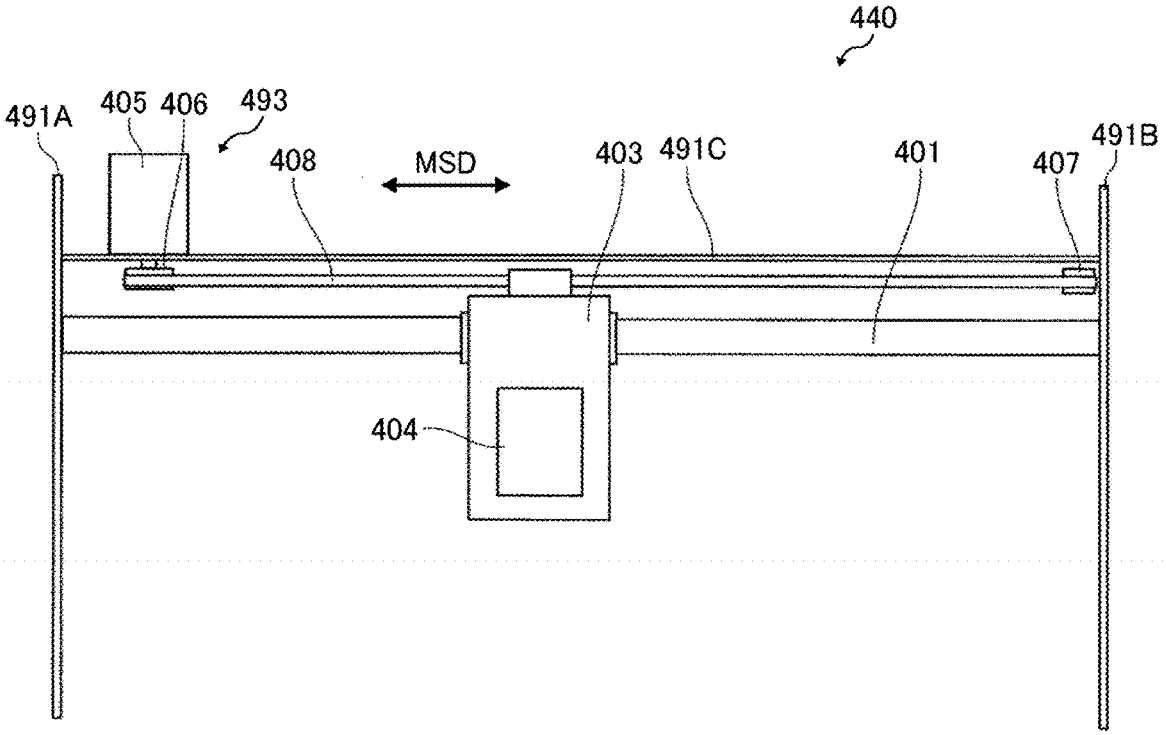
FIG. 16 is a top view of an example of the liquid discharge device.

In still another example, the liquid discharge device 440 includes the head 404 movably held by the guide 401 that forms part of a main scan moving unit 493, so that the head 404 and the main scan moving unit 493 form a single unit. As illustrated in FIG. 16, the liquid discharge device 440 may include the head 404, the carriage 403, and the main scan moving unit 493 that form a single unit.

The main scan moving unit 493 includes a guide 401, a main scanning motor 405, a timing belt 408, and the like. The main scan moving unit 493 functions as a drive device to move the carriage 403 in the main scanning direction MSD. The guide 401 is bridged between the left-side plate 491A and right-side plate 491B to moveably hold the carriage 403. The main scanning motor 405 reciprocally moves the carriage 403 in the main scanning direction MSD via the timing belt 408 bridged between a driving pulley 406 and a driven pulley 407.

In FIG. 16, the liquid discharge device 440 includes a housing, the main scan moving unit 493, the carriage 403, and the head 404 among components of the liquid discharge apparatus 500 as described below. The left-side plate 491A, the right-side plate 491B, and the rear side plate 491C constitute the housing. The main scanning direction is indicated by arrow "MSD" in FIG. 16.

In still another example, a cap that forms part of a recovery device 337 is secured to the carriage 403 mounting the head 404 so that the head 404, the carriage 403, and the recovery device 337 form a single unit to form the liquid discharge device 440.

Figure 17:
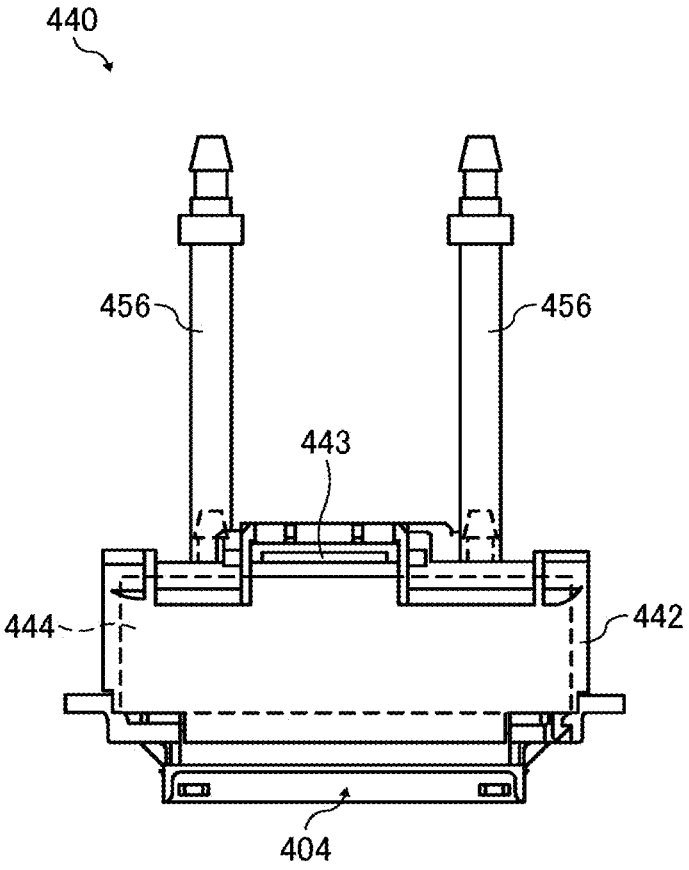
FIG. 17 is a side view of an example of the liquid discharge device.

Further, in still another example, the liquid discharge device 440 includes tubes 456 connected to the head 404 mounting a channel part 444 so that the head 404 and a supply unit form a single unit as illustrated in FIG. 17. The liquid in the liquid storage source is supplied to the head 404 through the tube 456 and the head tank 441.

Further, the channel part 444 is disposed inside a cover 442. Instead of the channel part 444, the liquid discharge device 440 may include the head tank 441. A connector 443 electrically connected with the head 404 is provided on an upper part of the channel part 444.

The main scan moving unit 493 may be a guide only. The supply unit may be a tube(s) only or a loading unit only.

Figure 18A:
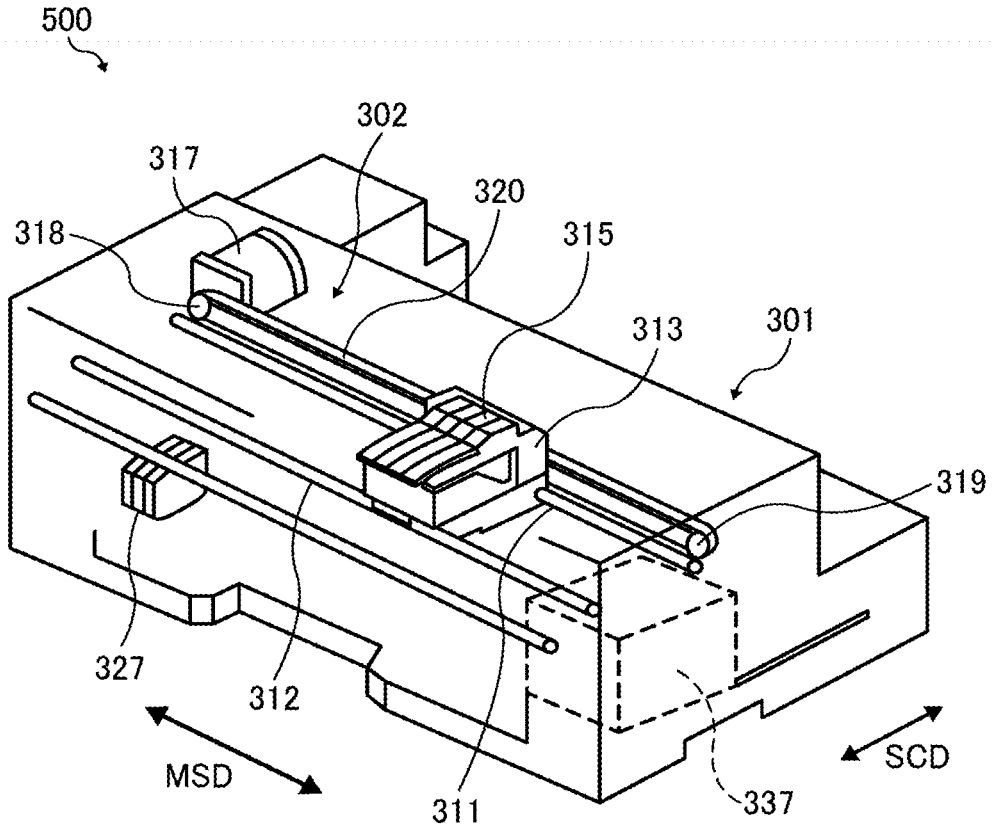
Figure 18B:
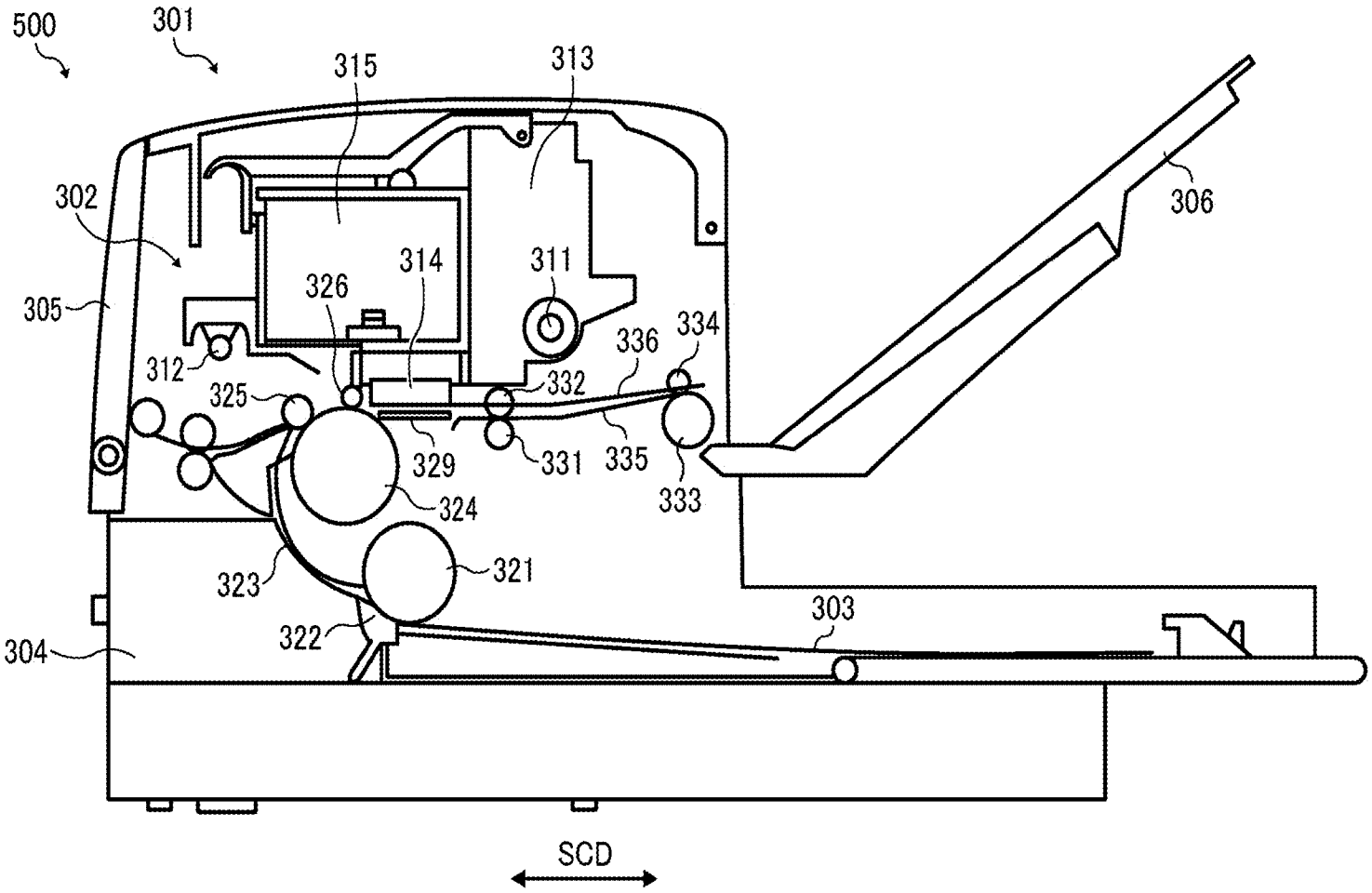

FIGS. 18A and 18B illustrate an example of an inkjet image forming apparatus 301 as a liquid discharge apparatus 500 mounting the head 404 as an inkjet head. FIG. 18A is a schematic perspective view of a main part of the liquid discharge apparatus 500. FIG. 18B is a side view of the liquid discharge apparatus 500.

The inkjet image forming apparatus 301 includes the liquid discharge device 440 in the printing assembly 302. The liquid discharge device 440 includes a carriage 313 movable in a main scanning direction MSD inside an apparatus body, recording heads 314 including the heads 404 according to the above-described embodiments mounted on the carriage 313, and ink cartridges 315 to supply ink to the recording heads 314 in an apparatus body.

The main scanning direction is indicated by arrow MSD in FIG. 18A. The inkjet image forming apparatus 301 further includes a sheet feeding cassette 304 (sheet tray) to stack a large number of recording sheets 303 as recording media. The sheet feeding cassette 304 is attached to a lower portion of the apparatus body in such a manner that the sheet feeding cassette 304 can be detachably attachable to a front side of the apparatus body.

Further, the inkjet image forming apparatus 301 (liquid discharge apparatus 500) includes a manual feed tray 305 to manually feed the recording sheets 303. When the recording sheet 303 fed from the sheet feeding cassette 304 or the manual feed tray 305 is conveyed to the printing assembly 302, the printing assembly 302 records a desired image onto the recording sheet 303. The recording sheet 303 is ejected to a sheet ejection tray 306 mounted on a rear side of the apparatus body.

The printing assembly 302 holds the carriage 313 with a main guide rod 311 and a sub-guide rod 312 so that the carriage 313 is slidably movable in the main scanning direction MSD. The main guide rod 311 and the sub-guide rod 312 are guides laterally bridged between left and right-side plates. The main scanning direciton MSD is parallel to a surface of the recording sheet 303.

The carriage 313 mounts a recording head 314 that includes four inkjet heads (heads 404) to discharge droplets of yellow (Y), cyan (C), magenta (M), and black (B) inks, respectively. Each of the heads 404 includes multiple of nozzles arrayed in a nozzle array direction.

The recording heads 314 is mounted on the carriage 313 so that the nozzle array direction intersecting the main scanning direction MSD. The recording head 314 is mounted on the carriage 313 so that the liquid is discharged downward Further, the ink cartridges 315 to supply ink of each color to the recording head 314 are exchangeably mounted on the carriage 313.

Each of the ink cartridges 315 has an atmosphere communication port, a supply port, and a porous body. The atmosphere communication port is disposed at an upper portion of each ink cartridges 315 to communicate with the atmosphere. The supply port is disposed at a lower portion of each ink cartridges 315 to supply ink to the recording heads 314. The porous body is disposed inside each ink cartridges 315 to be filled with ink. Ink to be supplied to the recording heads 314 is kept at a slight negative pressure in the ink cartridges 315 by capillary force of the porous body.

Although the recording heads 314 of each color are used in FIGS. 17A and 17B as the recording heads, the recording heads 314 may be a single head having nozzles 44 discharging ink droplets of each color.

Further, the inkjet head (head 404) used as the recording head 314 may be a piezo-type that applies pressure to the ink through a diaphragm 15 that forms a wall of the liquid chamber with an electromechanical transducer element such as a piezoelectric element, or a bubble-type that generates air bubbles with a heating resistor to pressurize the ink, or an electrostatic-type in which the diaphragm 15 is displaced by the electrostatic force generated between the diaphragm 15 and an electrode facing the diaphragm 15 to pressurize the ink. An inkjet head of an electrostatic type is used in the present disclosure.

A rear side (a downstream side in a sheet conveyance direction) of the carriage 313 is slidably fitted to the main guide rod 311, and a front side (an upstream side in a sheet conveyance direction) of the carriage 313 is slidably mounted to the sub-guide rod 312. The sheet conveyance direction along which the recording sheet 303 is conveyed is indicated by "SCD" in FIGS. 17A and 17B.

To scan the carriage 313 in the main scanning direction MSD, a timing belt 320 is stretched between a driving pulley 318 driven and rotated by a main scanning motor 317 and a driven pulley 319. The timing belt 320 is secured to the carriage 313. The carriage 313 is reciprocally moved (scanned) by forward and reverse rotations of the main scanning motor 317.

The inkjet image forming apparatus 301 (liquid discharge apparatus 500) further includes a sheet feed roller 321, a friction pad 322, a sheet guide 323, conveyance rollers 324 and 325, and a leading end roller 326 to convey the recording sheet 303, which is set in the sheet feeding cassette 304, to a portion below the recording heads 314. The sheet feed roller 321 and the friction pad 322 separates and feeds the recording sheets 303 sheet by sheet from the sheet feeding cassette 304.

The sheet guide 323 guides the recording sheets 303. The conveyance roller 324 reverses and conveys the recording sheet 303 fed from the sheet feed roller 321. The conveyance roller 325 is pressed against a circumferential surface of the conveyance roller 324. The leading end roller 326 defines an angle at which the recording sheet 303 is fed from the conveyance rollers 324 and 325. The conveyance roller 324 is rotationally driven by a sub-scanning motor 327 via a gear train.

The inkjet image forming apparatus 301 (liquid discharge apparatus 500) further includes a print receiver 329 disposed below the recording heads 314. The print receiver 329 is a sheet guide to guide the recording sheet 303, which is fed from the conveyance roller 324, in a range corresponding to a range of movement of the carriage 313 in the main scanning direction MSD.

On a downstream side of the print receiver 329 in the sheet conveyance direction SCD, the inkjet image forming apparatus 301 (liquid discharge apparatus 500) includes a conveyance roller 331, a spur roller 332, a sheet ejection roller 333, a spur roller 334, and guides 335 and 336.

The conveyance roller 331 is driven to rotate with the spur roller 332 to feed the recording sheet 303 in a sheet ejection direction (sheet conveyance direction SCD). The sheet ejection roller 333 and the spur roller 334 further feed the recording sheet 303 to the sheet ejection tray 306. The guides 335 and 336 form a sheet ejection path.

In recording, the inkjet image forming apparatus 301 (liquid discharge apparatus 500) drives the recording heads 314 according to image signals while moving the carriage 313, to discharge ink onto the recording sheet 303, which is stopped below the recording heads 314, by one line of a desired image.

Then, the recording sheet 303 is fed by a predetermined amount and another line is recorded. When a recording end signal or a signal indicating that a rear end of the recording sheet 303 arrives at a recording area is received, a recording operation is terminated and the recording sheet 303 is ejected.

Further, a recovery device 337 to recover a discharge failure of the recording head 314 is disposed at a position out of the recording area on a right side in the moving direction of the carriage 313. The recovery device 337 includes a cap, a suction unit, and a cleaning unit.

In a print standby state, the carriage 313 is moved to a side at which the recovery device 337 is disposed, and the recording heads 314 are capped with the cap.

Accordingly, the nozzles 44 (discharge ports) are kept in a wet state, thus preventing discharge failure due to the drying of ink. The inkjet image forming apparatus 301 (liquid discharge apparatus 500) discharges ink not relating to the recording in the middle of the recording, for example, to maintain the viscosity of ink in all of the nozzles 44 constant, thus maintaining the head 404 to stably discharge the liquid (ink).

When a discharge failure has occurred, the nozzles 44 of the recording heads 314 are tightly sealed with the cap, the suction unit sucks ink and bubbles, for example, from the nozzles 44 via tubes, and the cleaning unit removes ink and dust adhered to the surfaces of the nozzles 44, thus recovering the recording head 314 from the discharge failure. The sucked ink is discharged to a waste ink container disposed on a lower portion of the apparatus body and is absorbed into and held in an ink absorber in the waste ink container.

Numerous additional modifications and variations are possible in light of the above teachings. Such modifications and variations are not to be regarded as a departure from the scope of the present disclosure and appended claims, and all such modifications are intended to be included within the scope of the present disclosure and appended claims.

What is claimed is:

1. A liquid discharge head, comprising:

a nozzle plate including a nozzle surface in which a plurality of nozzles is formed, the plurality of nozzles being arranged in a nozzle array direction on the nozzle surface;

a frame member including attachment portions, each arranged on a side surface of the frame member, the frame member having two end surfaces in the nozzle array direction; and a pair of head protectors fitted to the attachment portions and respectively attached to the end surfaces of the frame member in the nozzle array direction, wherein each head protector comprises a cover surface to cover a part of the nozzle surface of the liquid discharge head;

a fitting surface to be fitted to one of the attachment portions on the side surface of the frame member, the side surface intersecting the nozzle surface; and a biasing surface including a biasing part to bias the head protector against one of the two end surfaces of the frame member in the nozzle array direction each end surface intersecting the side surface and the nozzle surface.

2. The liquid discharge head according to claim 1, wherein each head protector includes another fitting surface so that the fitting surface and the another fitting surface constitute a pair of fitting surfaces opposed to each other, and wherein the pair of fitting surfaces is perpendicular to the biasing surface.

3. The liquid discharge head according to claim 1, wherein, for each head protector, a center of the biasing part is disposed above a center of the one of the attachment portions to which the fitting surface is fitted in a vertical direction perpendicular to the nozzle surface, and the nozzle surface is disposed below the center of the one of the attachment portions in the vertical direction.

4. The liquid discharge head according to claim 1, wherein each attachment portion includes a projection, the fitting surface of each head protector includes a hole to which the projection of the one of the attachment portions is fittable, and the hole has a size larger than the projection in the direction parallel to the nozzle surface.

5. The liquid discharge head according to claim 1, wherein each head protector is formed of an elastic material.

6. The liquid discharge head according to claim 1, wherein each attachment portion of the frame member includes a projection, and the fitting surface of each head protector includes a hole to which the projection of the one of the attachment portions is fitted.

7. An image forming apparatus comprising:

the liquid discharge head according to claim 1; and a wiper to wipe the nozzle surface in the direction parallel to the nozzle surface.

8. The liquid discharge head of claim 1, wherein the bias part of each head protector presses against one of the two end surfaces of the frame member in the nozzle array direction.

9. The liquid discharge head of claim 1, wherein the cover surface of each head protector covers the part of the nozzle surface across a full extent of the nozzle surface in a direction perpendicular to the nozzle array direction.

* * * * *